US009038875B2

(12) United States Patent
Jesewitz

(10) Patent No.: US 9,038,875 B2
(45) **Date of Patent: *May 26, 2015**

(54) HEIGHT ADJUSTABLE TOWER WITH INTEGRATED CARGO RACK APARATUS FOR WAKEBOARD BOATS

(71) Applicant: Raymond L. Jesewitz, Orlando, FL (US)

(72) Inventor: Raymond L. Jesewitz, Orlando, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/967,137

(22) Filed: Aug. 14, 2013

(65) Prior Publication Data

US 2015/0048130 A1 Feb. 19, 2015

Related U.S. Application Data

(63) Continuation-in-part of application No. 13/214,149, filed on Aug. 19, 2011, now Pat. No. 8,567,651, which is a continuation-in-part of application No. 11/711,282, filed on Feb. 27, 2007, now Pat. No. 8,025,194.

(60) Provisional application No. 60/777,060, filed on Feb. 27, 2006.

(51) Int. Cl.

| | |
|---|---|
| ***B63B 17/00*** | (2006.01) |
| ***B63B 25/00*** | (2006.01) |
| ***B60R 9/08*** | (2006.01) |
| *B63B 25/18* | (2006.01) |
| *B63B 35/79* | (2006.01) |
| *B63B 35/81* | (2006.01) |

(52) U.S. Cl.
CPC . *B60R 9/08* (2013.01); *B63B 25/18* (2013.01); *B63B 35/7946* (2013.01); *B63B 35/815* (2013.01); *B63B 25/002* (2013.01)

(58) Field of Classification Search
CPC .. B63B 25/002; B63B 25/18; B63B 35/7946; B63B 35/815
USPC ..... 224/406, 274, 405, 311, 280, 401, 282, 224/548, 549, 553; 114/343, 364
See application file for complete search history.

(56) References Cited

U.S. PATENT DOCUMENTS

| | | | | |
|---|---|---|---|---|
| 3,049,273 | A * | 8/1962 | Crane | 224/311 |
| 3,261,521 | A * | 7/1966 | Meccico et al. | 224/553 |
| 4,424,907 | A * | 1/1984 | Robb | 211/70.8 |
| 5,094,351 | A * | 3/1992 | Barney | 211/70.8 |
| D434,718 | S * | 12/2000 | Kreisler | D12/412 |
| 6,257,261 | B1 * | 7/2001 | Johnson | 135/96 |
| 6,327,993 | B1 * | 12/2001 | Richens, Jr. | 114/361 |
| 6,349,666 | B1 * | 2/2002 | Hastings | 114/361 |
| 6,439,150 | B1 * | 8/2002 | Murphy et al. | 114/361 |

(Continued)

*Primary Examiner* — Justin Larson
(74) *Attorney, Agent, or Firm* — Paul Royal, Jr.; The Patent Guild

(57) ABSTRACT

The present invention provides an improved height adjustable tower with integrated cargo rack apparatus for wakeboard boats. The inventive apparatus enables the adjustability of the height of the cargo rack/bimini which is accomplished by lowering or raising the lower tower legs with an actuator after releasing a locking mechanism. The apparatus also includes a displacement mechanism which allows the cargo rack to be simultaneously translated and rotated. The benefit to the user is the ability to control the amount of shade/sun for the people in the general cockpit area. It also allows a user to achieve a higher walk-through height for ease of maneuvering in the boat and provides easy access to items stored on top of the cargo rack.

8 Claims, 16 Drawing Sheets

INTEGRATED CARGO RACK - UPPER HEIGHT LIMIT

(56) References Cited

U.S. PATENT DOCUMENTS

| | | | | |
|---|---|---|---|---|
| 6,572,168 | B1 * | 6/2003 | Radstake | 312/247 |
| 6,666,159 | B2 * | 12/2003 | Larson et al. | 114/253 |
| 6,666,163 | B2 * | 12/2003 | Pastor et al. | 114/361 |
| 6,691,637 | B1 * | 2/2004 | Smith et al. | 114/361 |
| 6,755,332 | B2 * | 6/2004 | Crane et al. | 224/321 |
| 6,799,529 | B1 * | 10/2004 | Willis | 114/361 |
| 6,802,275 | B2 * | 10/2004 | Schmidt | 114/361 |
| 6,866,001 | B1 * | 3/2005 | Cuccia | 114/343 |
| 6,907,642 | B1 * | 6/2005 | Czipri | 16/367 |
| 6,988,461 | B1 * | 1/2006 | James | 114/364 |
| 7,219,617 | B2 * | 5/2007 | Metcalf | 114/364 |
| 7,418,918 | B2 * | 9/2008 | Bierbower et al. | 114/361 |
| 7,490,574 | B2 * | 2/2009 | Shearer et al. | 114/361 |
| D597,922 | S * | 8/2009 | Davis | D12/317 |
| D606,481 | S * | 12/2009 | Stepp | D12/317 |
| 7,895,964 | B2 * | 3/2011 | Russikoff | 114/361 |
| 7,950,342 | B2 * | 5/2011 | Russikoff | 114/361 |
| 8,025,194 | B2 * | 9/2011 | Jesewitz | 224/406 |
| D649,505 | S * | 11/2011 | O'Dell | D12/317 |
| 8,171,874 | B2 * | 5/2012 | Gasper | 114/364 |
| 8,205,571 | B1 * | 6/2012 | Rondeau et al. | 114/361 |
| 8,297,484 | B2 * | 10/2012 | Jesewitz et al. | 224/406 |
| 8,495,967 | B2 * | 7/2013 | Williams et al. | 114/361 |
| 8,522,709 | B2 * | 9/2013 | Williams et al. | 114/361 |
| 8,567,651 | B2 * | 10/2013 | Jesewitz | 224/406 |
| 8,905,281 | B2 * | 12/2014 | Jesewitz | 224/406 |
| 2005/0186029 | A1 * | 8/2005 | Jones | 403/385 |
| 2005/0194414 | A1 * | 9/2005 | Lynch | 224/401 |
| 2006/0037527 | A1 * | 2/2006 | Aff | 114/364 |
| 2006/0186154 | A1 * | 8/2006 | Myron et al. | 224/311 |
| 2014/0263906 | A1 * | 9/2014 | Jesewitz | 248/288.11 |

* cited by examiner

INTEGRATED CARGO RACK - UPPER HEIGHT LIMIT

INTEGRATED CARGO RACK – MID HEIGHT POSITION

INTEGRATED CARGO RACK - STOWED POSITION

INTEGRATED CARGO RACK - REAR TILTED

INTEGRATED CARGO RACK - UNDERSIDE

INTEGRATED CARGO RACK - UNDERSIDE
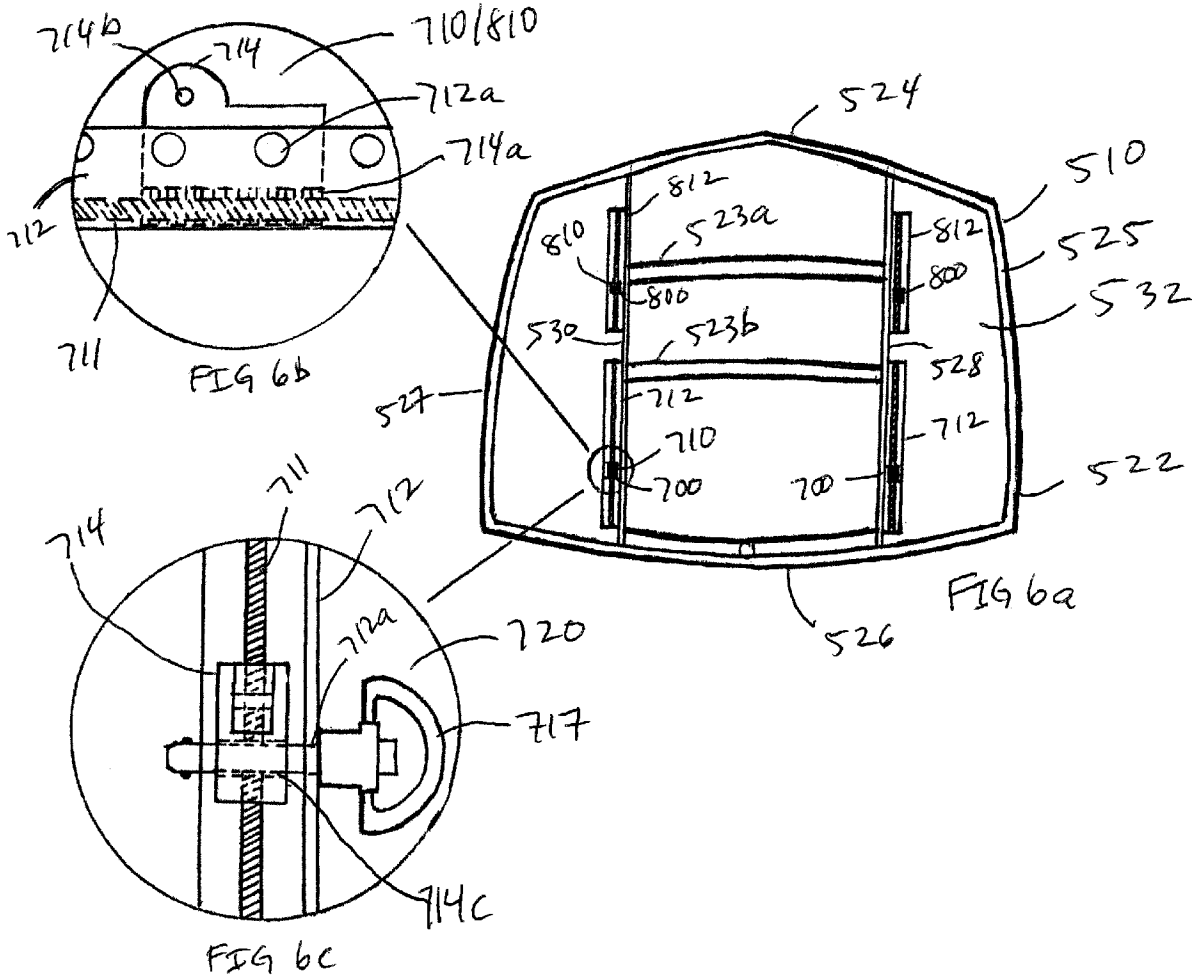

HEIGHT ADJUSTABLE TOWER WITH INTEGRATED CARGO RACK APARATUS FOR WAKEBOARD BOATS

CROSS REFERENCE TO RELATED APPLICATIONS

This application is a Continuation-in-Part of is U.S. Non-Provisional patent application Ser. No. 13/214,149, filed Aug. 19, 2011, which is a Continuation-in-Part of U.S. patent application Ser. No. 11/711,282, filed Feb. 27, 2007, now U.S. Pat. No. 8,025,194, which claims the benefit of U.S. Provisional Patent Application No. 60/777,060, filed Feb. 27, 2006 wherein these recited applications are incorporated by reference in their entirety as if fully set forth herein. Further this application claims all permissible benefits of U.S. patent application Ser. No. 13/180,542, filed Jul. 11, 2011, now U.S. Pat. No. 8,297,484 which is incorporated by reference in its entirety as if fully set forth herein.

FIELD OF THE INVENTION

The present invention relates generally to boating equipment and accessories, and more particularly to an improved height adjustable tower with integrated cargo rack apparatus for wakeboard boats and the like.

BACKGROUND OF THE INVENTION

It is a truism among boating enthusiasts that there is never enough storage room on a boat. This is particularly true in wakeboarding and related water sports, where the boater may need a place to store wakeboards, surfboards, wakesurf boards, tubes, inflatables, kayaks, accessories, and/or other sport cargo.

U.S. Pat. No. 6,592,819 to Larson, et al. discloses a water sport towing apparatus. U.S. Pat. No. 5,752,638 to Meeks describes a combination water ski and wake board rack. United States Patent Application 60060053313 by Murphy, et al. teaches a shade cover assembly adapted to be carried on a tower above the cockpit area of a pleasure boat.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

SUMMARY OF THE INVENTION

Disclosure of Invention

The present invention provides an improved height adjustable tower with integrated cargo rack apparatus for wakeboard boats and the like. The inventive apparatus enables the adjustability of the height of the cargo rack/bimini which is accomplished by lowering or raising the lower tower section with an actuator, gas spring, or tensioner cable after releasing a locking mechanism. The range in height would be approximately 20", adjustable from 50" to 70" as measured at the front of the rack to the floor of the boat. The benefit to the user is the ability to control the amount of shade/sun for the people in the general cockpit area. It also allows a user to achieve a higher walk-through height for ease of maneuvering in the boat. Generally there is a trade off between the amount of sun coverage and height of the bimini portion of the rack. This feature allows the user to easily adjust the height to his/her liking.

It is therefore an object of the present invention to provide a new and improved height adjustable tower with integrated cargo rack apparatus for wakeboard boats and the like.

Other novel features which are characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the national patent office(s) and the public generally, and especially the scientists, engineers and practitioners in the art who are not familiar with patent or legal terms or phraseology, to determine quickly from a cursory inspection the nature and essence of the technical disclosure of the application.

The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE PREFERRED EMBODIMENTS

As disclosed herein, essential elements of the height adjustable tower with integrated cargo rack apparatus include, but are not limited to: a tower base rigidly attached to a boat gunwale, the tower base having an actuator or gas spring; vertical supports extending from the tower base and pivotally operated by the actuator or gas spring; and a pivotally adjustable cargo rack apparatus supported by the vertical supports. As described below, the multiplicity of adjustable and pivotal features work in conjunction with each other to maximize the unique functionality of the instant apparatus.

While the preferred cargo rack apparatus is presented herein, it is understood alternate embodiments may encompass cargo racks differently configured or bimini tops (such as collapsible or welded frame bimini tops) as generally used within the industry. While these alternate cargo rack apparatus embodiments may present elements of the instant invention, it is understood that they are not necessarily the equivalent to the cargo rack of the preferred embodiment of the instant invention or of the height adjustable tower with integrated cargo rack apparatus of the instant invention.

Height Adjustable Tower

As shown at least in FIG. 1-20, the height adjustable tower with integrated cargo rack apparatus 500 includes at least one wakeboard tower 514 and integrated tower mount 590 wherein the integrated tower mount 590 is pivotally connected to a tower base 595.

Figure 1:
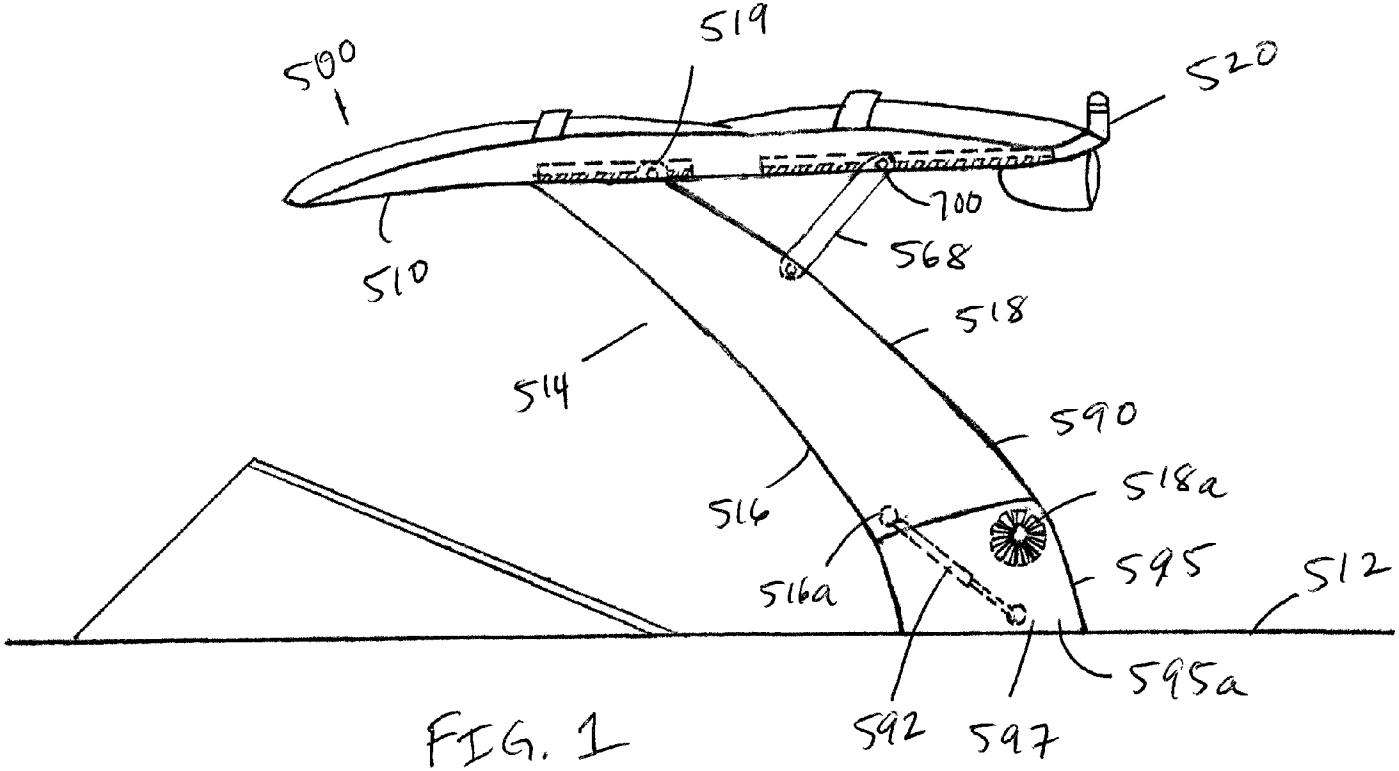
FIG. 1 is a side view of the height adjustable tower with integrated cargo rack apparatus at the upper limit position.

As shown in FIG. 1, the preferred embodiment of the present invention includes a wakeboard tower 514 connected to a integrated tower mount 590 which is connected to a tower base 595*a* which itself is connected to a boat 512 gunwale at the port side of the boat and a wakeboard tower 514 connected to a integrated tower mount 590 which is connected to a tower base 595*b* which itself is connected to a boat 512 gunwale at the starboard side of the boat.

Figure 2:
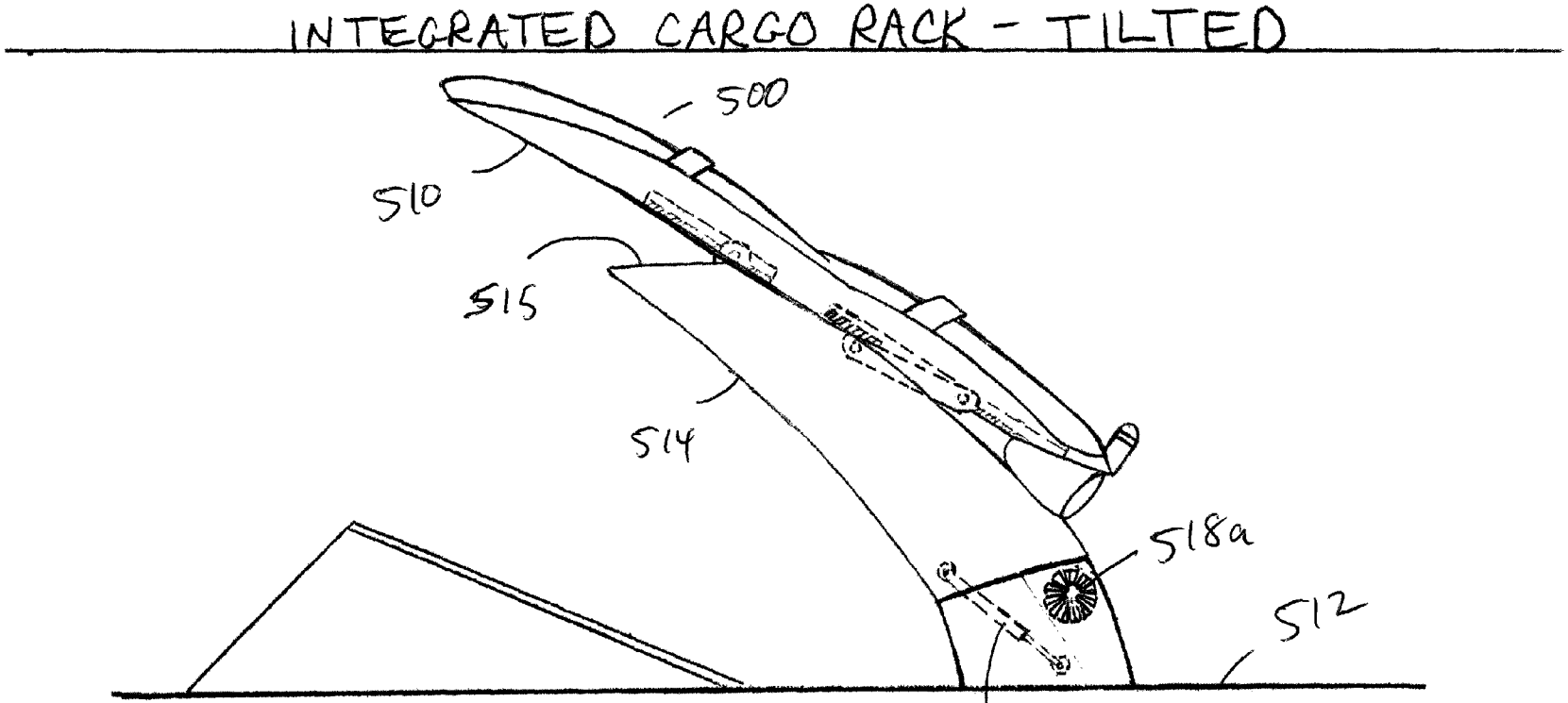
FIG. 2 is a side view of the height adjustable tower with integrated cargo rack apparatus tilted.
Figure 3:
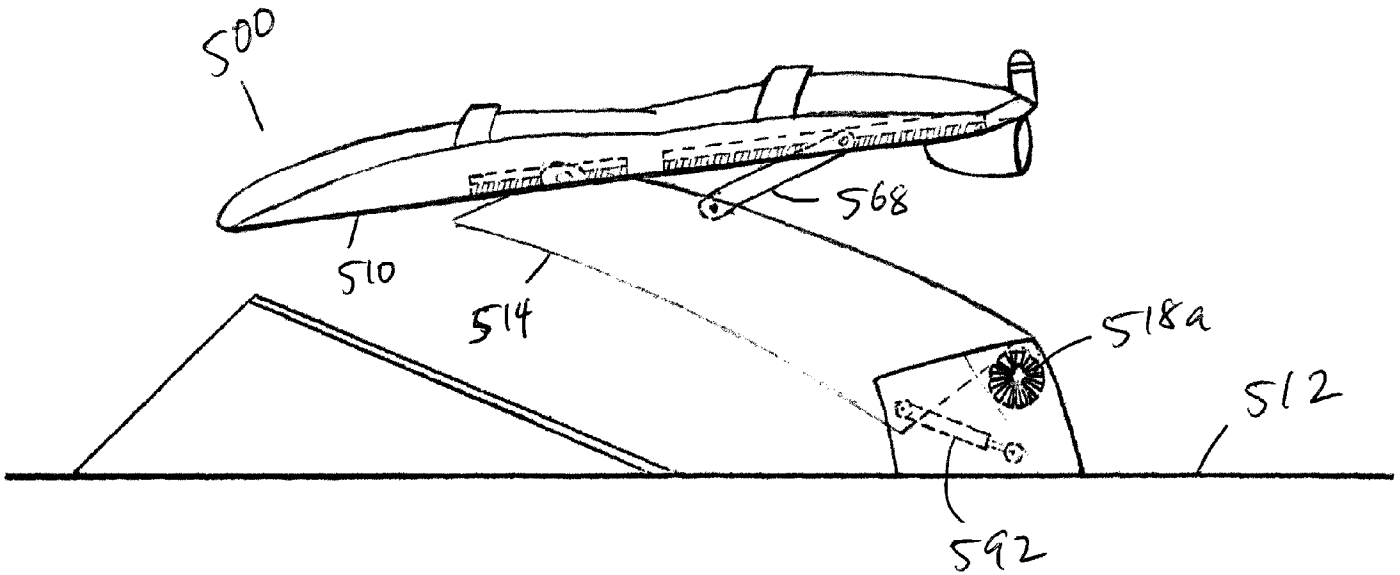
FIG. 3 is a side view of the height adjustable tower with integrated cargo rack apparatus at the mid-height position.
Figure 4:
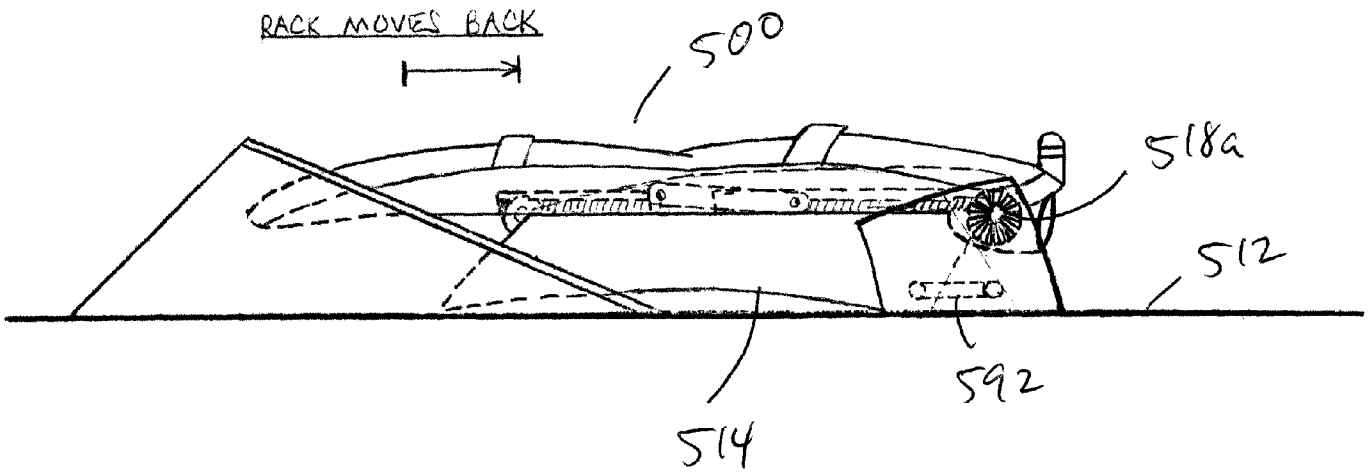
FIG. 4 is a side view of the height adjustable tower with integrated cargo rack apparatus at the stowed position.
Figure 5:
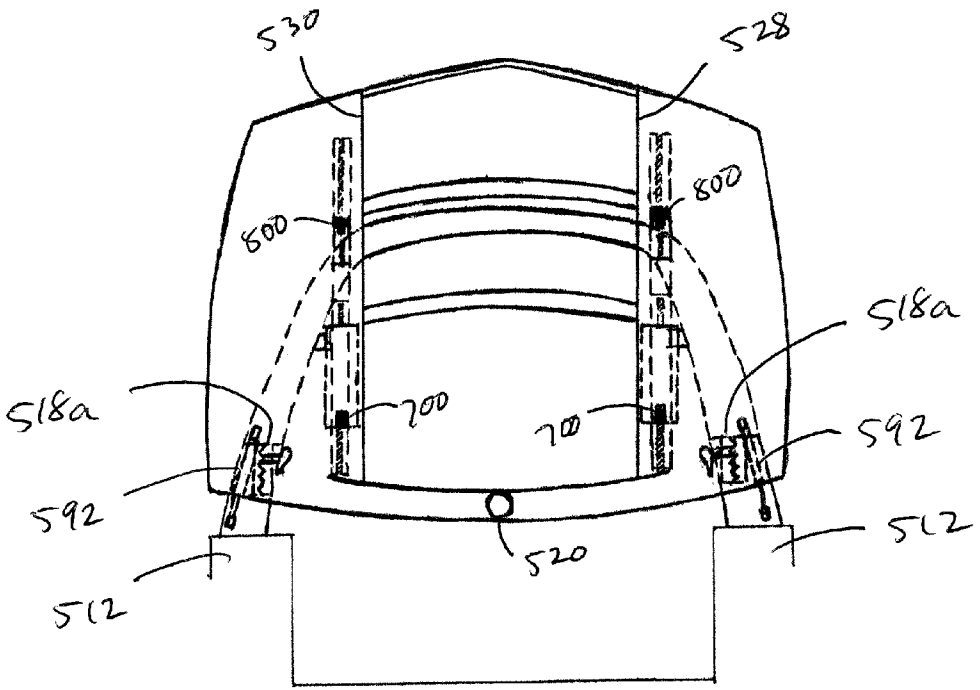
FIG. 5 is a top view of the height adjustable tower with integrated cargo rack apparatus.

As shown at least in FIGS. 2, 4, and 5, the wakeboard tower 514 includes an interconnecting upper end horizontal support 515 which extends from the wakeboard tower 514 portion adjacent the port side gunnel (aka gunwale) to wakeboard tower 514 portion adjacent the starboard side gunnel (aka gunwale).

Whereas tower bases 595*a*, 595*b*, integrated tower mounts 590*a*, 590*b*, and towers 514*a*, 514*b* are respectively symmetrical with the exception that they are designed for their specific port or starboard location on the boat, within the present application they are respectively designated tower base 595, integrated tower mount 590, and tower 514 unless noted otherwise.

As shown in FIG. 1, each wakeboard tower 514 includes a forward vertical support edge 516 pivotally connected to the integrated tower mount 590 at pivot joint 516*a*, and an aft vertical support edge 518 which is pivotally connected to both the upper rear of the housing of tower base 595 and to integrated tower mount 590 at aft pivot joint 518*a*.

As shown in FIGS. 1-5, the tower base 595 further includes a base actuator 592 extendably and retractably attached at a base actuator first end at pivot joint 516*a* positioned at the fore portion of the lower portion of integrated tower mount 590 and at a base actuator second end to the tower base aft lower portion 597. Tower base 595 further includes a tower base support, 597*a* extending from the tower base lower portion to the tower base upper portion.

FIG. 1 shows the base actuator 592 in a fully extended position (cargo rack at the upper height limit) and FIG. 4 shows the base actuator 592 in a fully retracted position (cargo rack stowed position) with the wakeboard tower 514 respectively shown positioned in correspondence with the position of the base actuator 592.

The base actuator 592 of the preferred embodiment is an electromechanical actuator however it is understood the actuator may, for alternative embodiments, be of an alternative type such as a hydraulic actuator, a electro-hydraulic, a pneumatic actuator, a electro-pneumatic actuator, or gas spring, compressed spring, or similar displacement producing component.

The tower base 595 also includes a base locking mechanism 594, as shown at least in FIGS. 7-20. The base locking mechanism 594 includes a base locking mechanism inboard support housing 600 attached to the integrated tower mount 590 at the aft pivot joint 518*a* which therefore allows the integrated tower mount 590 to rotate with respect to the tower base 595; a base locking mechanism cam lever 605; a base locking mechanism clamp threaded adjuster knob 610; a base locking mechanism spline 615 having a plurality of spline teeth 615*a* and a plurality of base locking mechanism pin holes 615*b*; a plurality of base locking mechanism pins 620; a base locking mechanism main shaft 630; a base locking mechanism adjuster bolt 640; a base locking mechanism clamp plate 650 having a plurality of base locking mechanism clamp plate indentions 650*a*; a plurality of base locking mechanism bearings 665; a plurality of base locking mechanism springs 670; a plurality of base locking mechanism washers 685; a base locking mechanism fastener 687, a base locking mechanism cam lever pin 689, and a base locking mechanism outboard support housing 690 for attachment to the tower base 595, the base locking mechanism outboard support housing 690 including a plurality of housing teeth 690*a*. The junction of the base locking mechanism inboard support housing 600 and the base locking mechanism outboard support housing 690 establish the aforementioned aft pivot joint 518*a*.

A unique feature of the base locking mechanism 594 is that it can be unlocked to allow the tower 514 to be tilted about aft pivot joint 518*a* and re-locked once the tower 514 is in the desired position.

With the base locking mechanism 594 assembled as shown in FIGS. 7-20, in the unlocked base position the base locking mechanism cam lever 605 is positioned to allow the free rotation of the base locking mechanism inboard support housing 600 with respect to the base locking mechanism outboard support housing 690.

Figure 8:
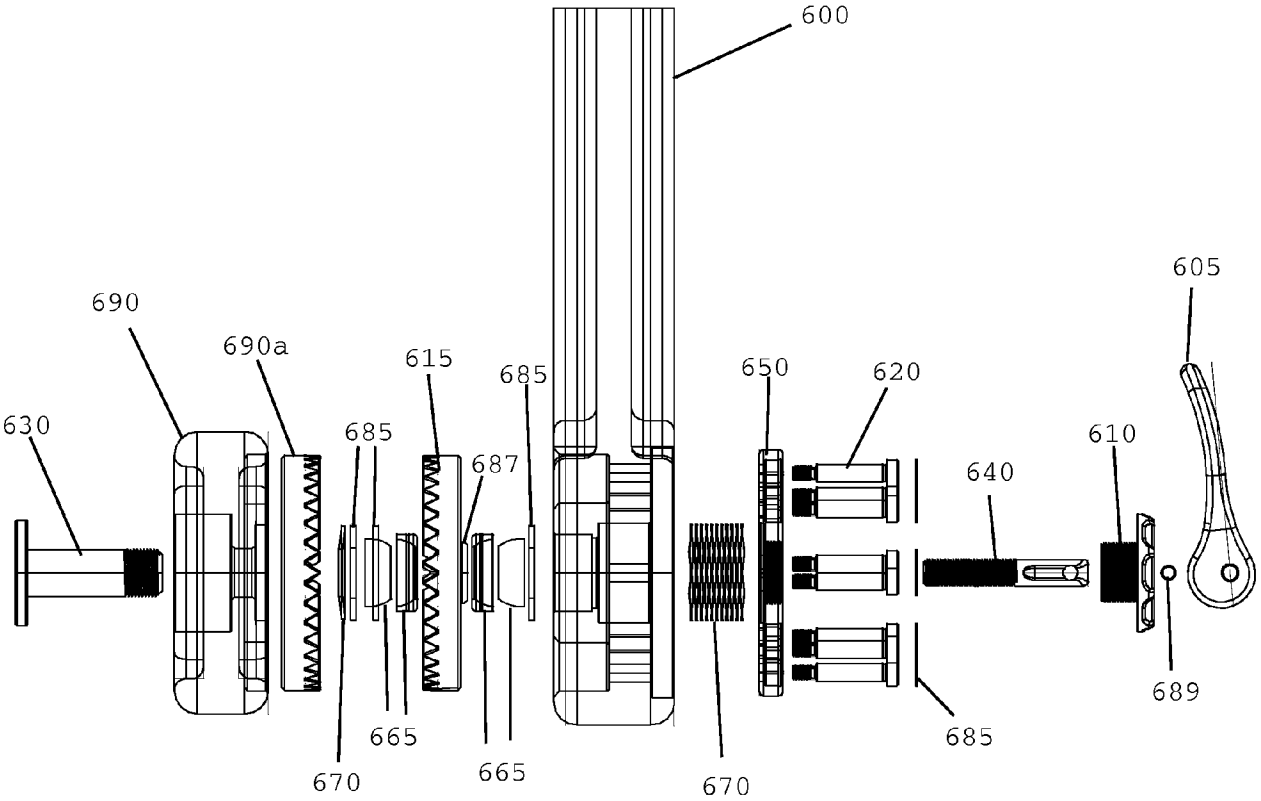
FIG. 8 shows an exploded view of the base locking mechanism.
Figure 9:
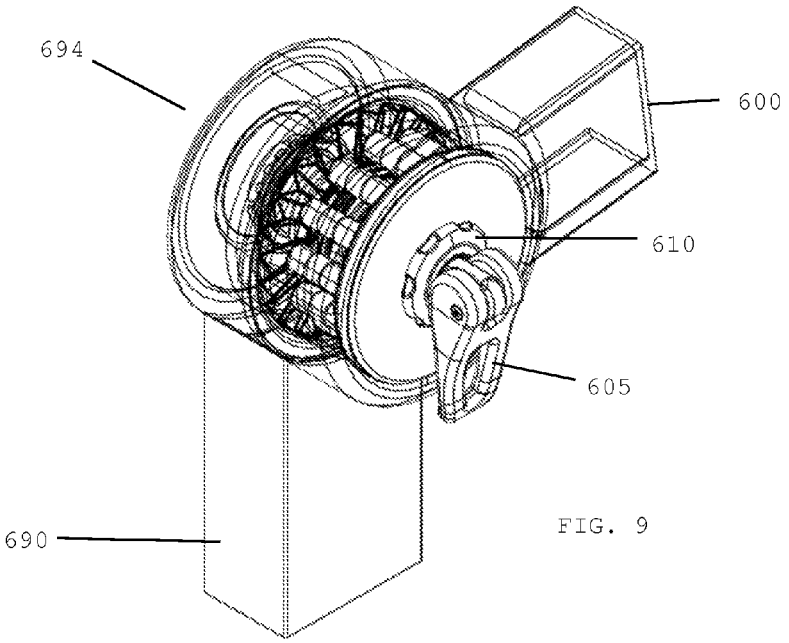
FIG. 9 shows an upper side wireframe view of the base locking mechanism.
Figure 10:
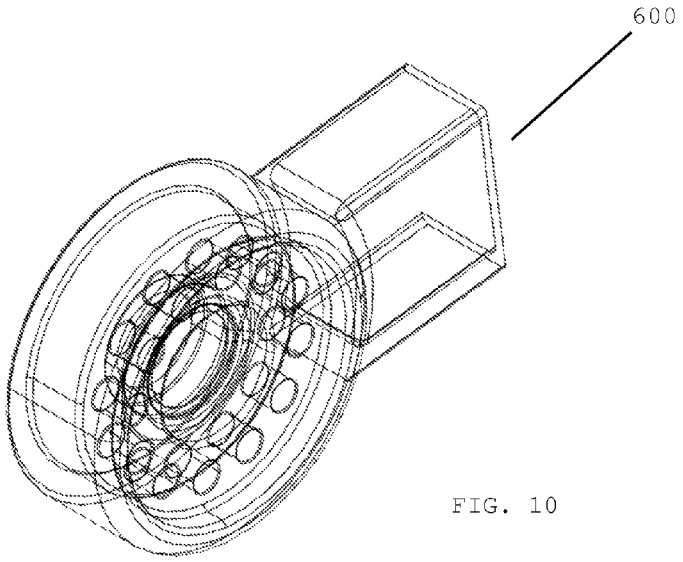
FIG. 10 shows an upper side wireframe view of the inboard support housing of the base locking mechanism.
Figure 11:
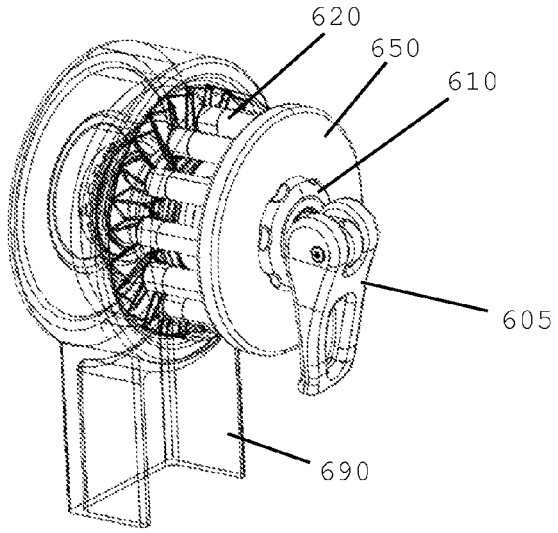
FIG. 11 shows a wireframe view of some of the components of the base locking mechanism.
Figure 12:
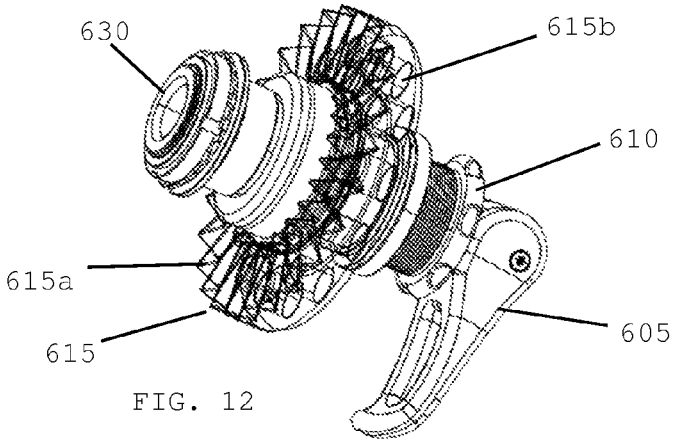
FIG. 12 shows a wireframe view of some of the components of the base locking mechanism.
Figure 13:
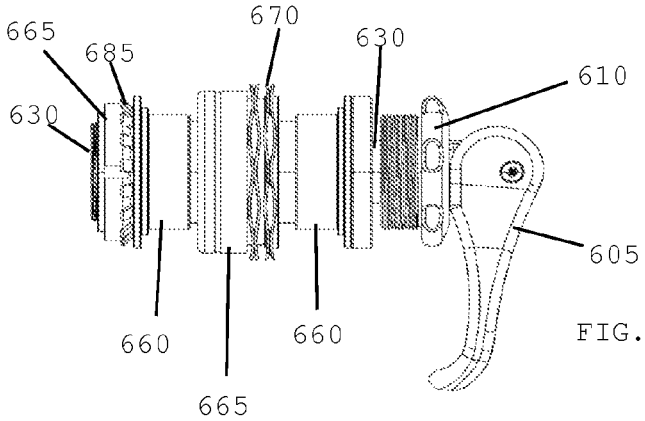
FIG. 13 shows a side view of some of the components of the base locking mechanism.
Figure 14:
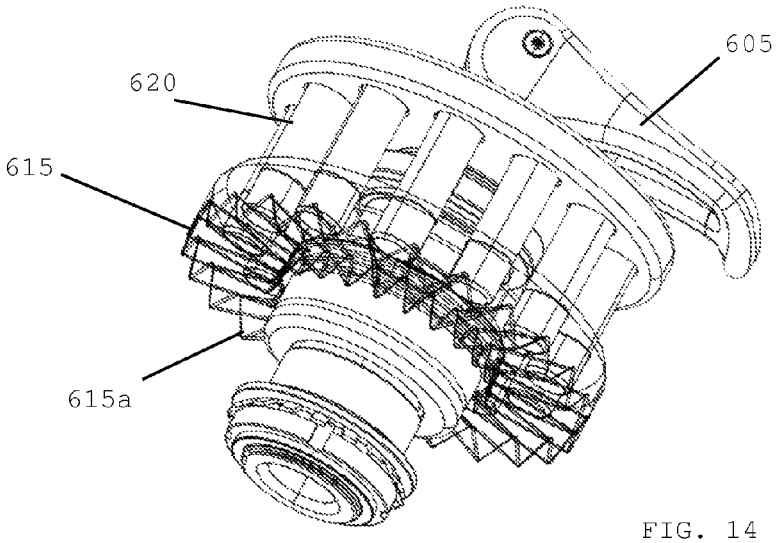
FIG. 14 shows a wireframe view of some of the components of the base locking mechanism.

In the unlocked position, within the base locking mechanism 594 the base locking mechanism spline teeth 615*a* are held apart from the base locking mechanism outboard support housing teeth 690*a* thereby allowing the rotation of the tower 514 through out a range of positions including fully extended to fully retracted or stowed. The interacting surface areas provided by the base locking mechanism outboard support housing teeth 690*a* and the base locking mechanism spline teeth 615*a* imbue the instant invention with the ability to withstand extreme loading conditions such as when the boat is towing a wakeboarder. Further, the spline teeth configuration, in conjunction with the base locking mechanism bearings 665 and unique base locking mechanism 594 assemblage as shown in FIG. 8 provides the height adjustable tower with integrated cargo rack apparatus 500 with robust and distinctive wakeboader towing capacity.

In the locked base position the locking mechanism cam lever 605 is positioned to prohibit the free rotation of the locking mechanism inboard support housing 600 with respect to the base locking mechanism outboard support housing 690.

In the locked position, within the base locking mechanism 594 the locking mechanism spline teeth 615*a* are held against the outboard support housing teeth 690*a* thereby preventing rotation of the locking mechanism inboard support housing 600 with respect to the base locking mechanism outboard support housing 690 and thereby preventing rotation of the tower 514.

Tower Height Adjustment Operation

FIGS. 1 thru 4 show the operation of the height adjustable tower with integrated cargo rack apparatus 500 from the fully extended position (FIG. 1) to the retracted and stowed position (FIG. 4). When the wakeboard towers 514 are in the maximum upright position (fully extended position), the upper ends of the wakeboard towers 514 are at their furthest distance from the gunwale of the boat 512. The base locking mechanism 594 of the tower base 590 is locked to hold the wakeboard towers 514 in the maximum upright position.

With the release of the base locking mechanism 594 on each of the two tower bases 595 the lower section of each tower 514 can be pivoted about aft pivot joints 518*a* to allow each tower 514 to tilt forward and downward towards the gunwale of the boat 512.

The movement of the lower section of each tower 514 is determined by operation of the base actuator 592 which is controlled via a base actuator control switch 592*a*. The base actuator control switch 592*a* includes operating functions which allow the bi-directional unison incremental tilting of the towers 514 as well as the bi-directional unison tilting of the towers 514 to preset height positions. Where non-powered base actuators (such as gas springs or compressed springs) are used, the weight of the load (cargo rack and vertical supports plus anything stored on the cargo rack) will determine the movement of the lower section of the towers 514.

The base actuator control switch 592*a* switch is provided either on the tower base 595, a dashboard control panel 592*c* of the boat 512, or at a location most suitable for boat users.

The base actuator 592 is connected to a base actuator safety stop switch 592*b* which cuts power to the base actuator 592 in the event that there is a person or persons in the area that the towers 514 moves. The base actuator safety stop switch 592*b* is provided either on the tower base 595, the dashboard control panel 592*c* of the boat 512, or at a location most suitable for boat users. The base actuator safety stop switch 592*b* may be one or more simple "kill" switches or one or more proximity switches which electrically sense the presence of a person or object.

Figure 15:
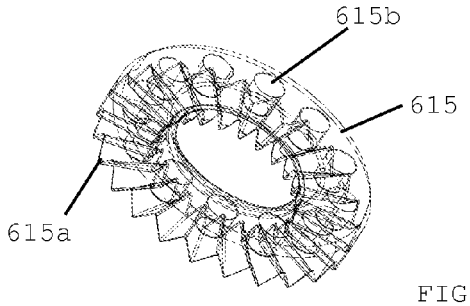
FIG. 15 shows a lower side wireframe view of the base locking mechanism spline.
Figure 16:
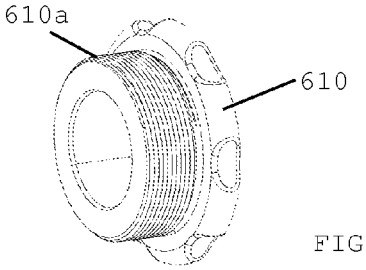
FIG. 16 shows an isometric view of the base locking mechanism spline adjuster knob.
Figure 17:
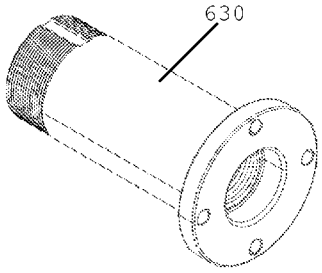
FIG. 17 shows an isometric view of the base locking mechanism spline adjuster shaft.
Figure 18:
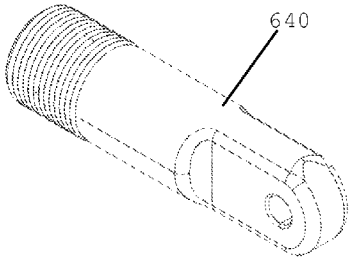
FIG. 18 shows an isometric view of the base locking mechanism spline adjuster bolt.
Figure 19:
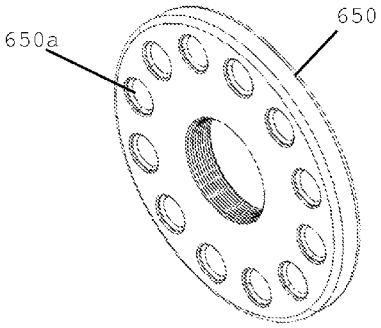
FIG. 19 shows an isometric rear view of the base locking mechanism clamp plate with a plurality of indentations.
Figure 20:
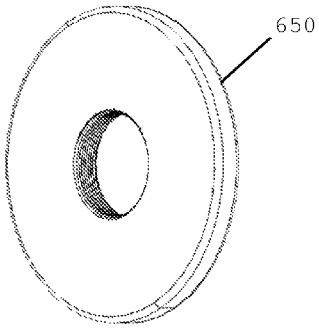
FIG. 20 shows an isometric front view of the base locking mechanism clamp plate.

The placement of the aft pivot point 518*a* at the upper rear of the tower base 595, as shown in at least in FIG. 15, is an essential element in the pivotal movement of the tower 514. This optimized location of aft pivot joint 518*a* allows the vertical support edge 516 to pivot down with minimal forward movement of the overall cargo rack apparatus 500. The bottom portion of the lower section of each tower 514 lowers into the housing of the respective tower base 595 when the tower 514 is folded down.

Height Adjustable Cargo Rack

As shown at least in FIGS. 1-6 of the preferred embodiment the height adjustable tower with integrated cargo rack apparatus of the instant invention further includes a cargo rack apparatus 500 supported by the upper ends of both the forward vertical support edge 516 near pivot joint 519 of each tower 514 upper end.

Note pivot joint 519 may be positioned in a variety of selected locations at the tower 514 upper end. As shown in FIGS. 1-4 the pivot joint 519 is provided at the aft portion of each tower 514 upper end.

As shown at least in FIGS. 1-4, the cargo rack apparatus 500 is pivotally and adjustably attached to each tower upper end pivot joint 519 (a releasable pivot joint) and at least one strut 568 as further described herein. The strut 568 may be a rigid link, an adjustable link, or an actuator similar to base actuator 592.

In the preferred embodiment as shown in FIG. 1, the at least one strut 568 is positioned adjacent the wake board tower aft vertical support edge 518.

Figure 1B:
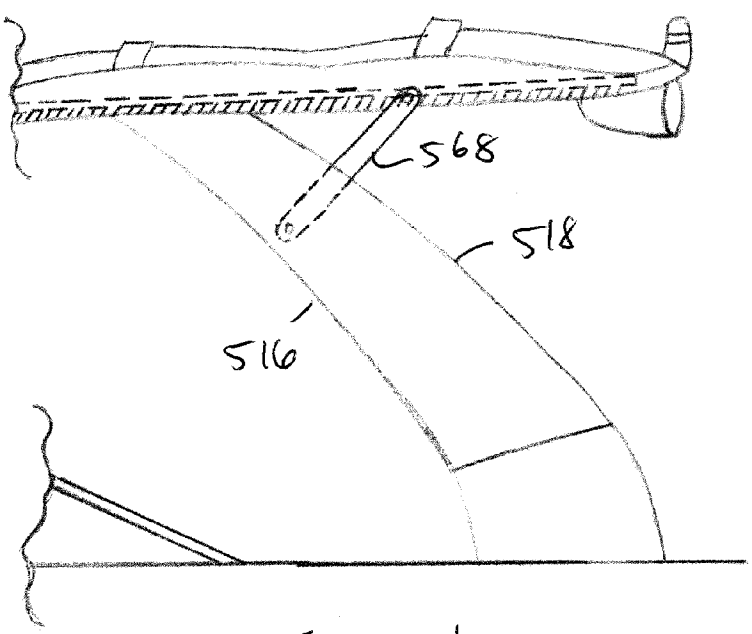
FIG. 1*b* is a side view of the height adjustable tower with integrated cargo rack apparatus with strut positioned adjacent the wake board tower forward vertical support edge.
Figure 1A:
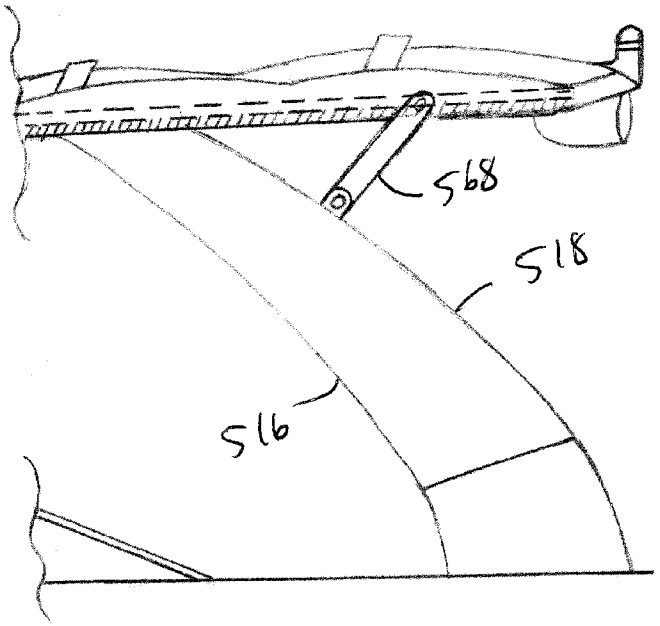
FIG. 1*a* is a side view of the height adjustable tower with integrated cargo rack apparatus with strut extending from the wake board tower aft vertical support edge.

As shown in FIG. 1*a*, the at least one strut 568 can be positioned to extend from the wake board tower aft vertical support edge 518.

Alternatively as shown in FIG. 1*b*, the strut 568 can be positioned adjacent the wake board tower forward vertical support edge 516.

Further, strut 568 can be positioned directly on either edge (516, 518) or at any location in between the edges (516, 518).

Also, it is understood the shape of strut 568 may be modified such that its shape allows the appropriate cargo rack displacement and pivoting as further described herein. For example link 568 may take the form of an "S" shape, 568*a*, as shown in FIGS. 6*d* and 6*e*, "C" shape, 568*b*, as shown in FIG. 6*f*, "Z" shape, 568*c*, as shown in FIG. 6*g* or as needed to provide the cargo rack 510 with pivotal attachment to the wake board tower 514 while also allowing translation of the cargo rack 510.

As shown at least in FIGS. 6, 6*a*, 6*b*, and 6*c*, the cargo rack apparatus 500 includes a cargo rack apparatus interior volume 532, and one or more connected peripheral rails 522 including a cargo rack fore interconnecting rail 523*a*, a cargo rack aft interconnecting rail 523*b*, a cargo rack apparatus front rail 524, a cargo rack apparatus port side rail 525, a cargo rack apparatus back rail 526, a cargo rack apparatus starboard side rail 527. Cargo rack apparatus 500 further includes port wall support 528 and starboard wall support 530.

Cargo rack apparatus 500 further includes wherein the fore interconnecting rail 523*a* and the aft interconnecting rail 523*b* interconnect opposing wall supports 528, 530 and also cooperate to provide a support surface for stored items.

Figure 6:
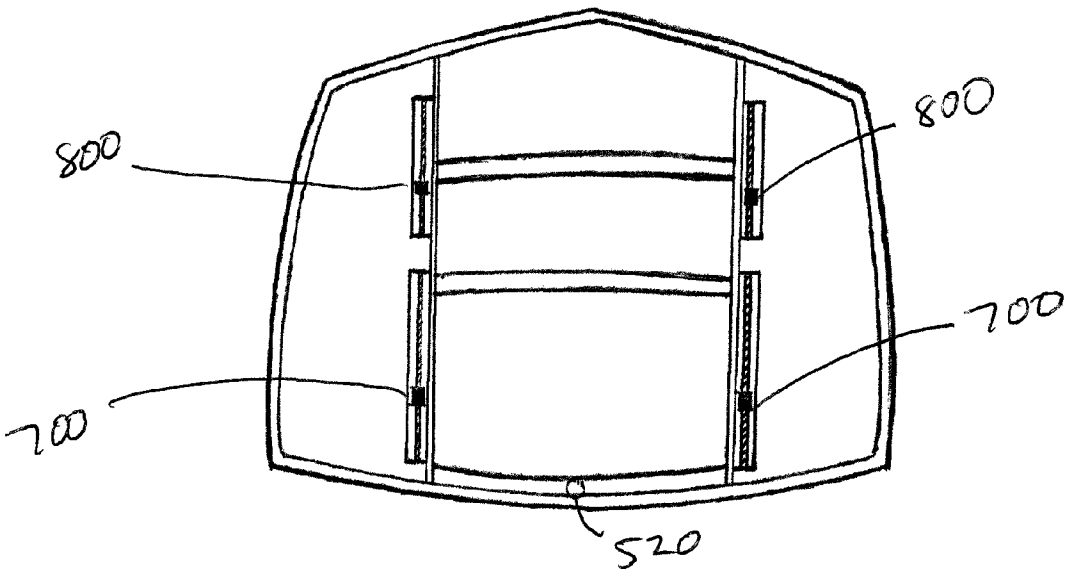
FIG. 6 is a bottom view of the cargo rack.
Figure 6A:
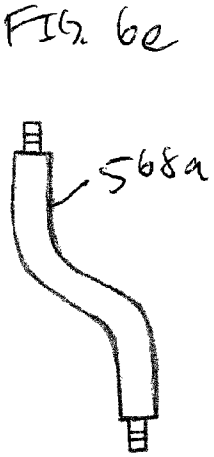
FIG. 6*a* is a bottom view of the cargo rack

As shown in FIGS. 6 and 6*a* the cargo rack 510 may be of varying width. In the preferred embodiment as shown in FIG. 5, the cargo rack 510 width can exceed the port gunnel to starboard gunnel width at the junction where the tower bases 595 meet the boat gunnel 512.

Alternatively the cargo rack 510 width may equal the approximate centerline of the port gunnel to starboard gunnel width at the junction where the tower bases 595 meet the boat gunnel 512.

Further the cargo rack 510 width can be less than the port gunnel to starboard gunnel width at the junction where the tower bases 595 meet the boat gunnel 512 such that the cargo rack 510, if unobstructed, could swing within the wakeboard tower 514. Importantly, the cargo rack 510 width of this configuration is not required to swing within the wakeboard tower but rather the cargo rack 510 is dimensioned such that it would fit within the port gunnel to starboard gunnel width at the junction where the tower bases 595 meet the boat gunnel 512.

A ski tow 520 is provided on the cargo rack apparatus back rail 526.

Cargo Rack Displacement and Pivoting

Positioned on each of the support walls 528, 530 is a first cargo rack displacement mechanism 700 and a second cargo rack displacement mechanism 800.

Note all elements of the first cargo rack displacement mechanism 700 and a second cargo rack displacement mechanism 800 are the same and the numbering of the elements are intended to be the same except the first cargo rack displacement mechanism has 700 series element numbering and second cargo rack displacement mechanism has 800 series element numbering. For example element 714*a* of the first cargo rack displacement mechanism 700 is understood to be of the same construction as element 814*a* of the second cargo rack displacement mechanism 800.

The first displacement mechanism 700 includes a first worm drive system 710 and a locking system 720.

Figure 6B:
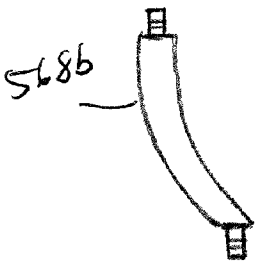
FIG. 6*b* is a side view of the cargo rack displacement mechanism.
Figure 6G:
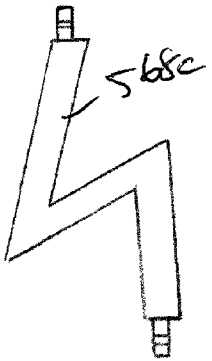
FIG. 6*g* is top view of an alternate link shape.
Figure 6D:
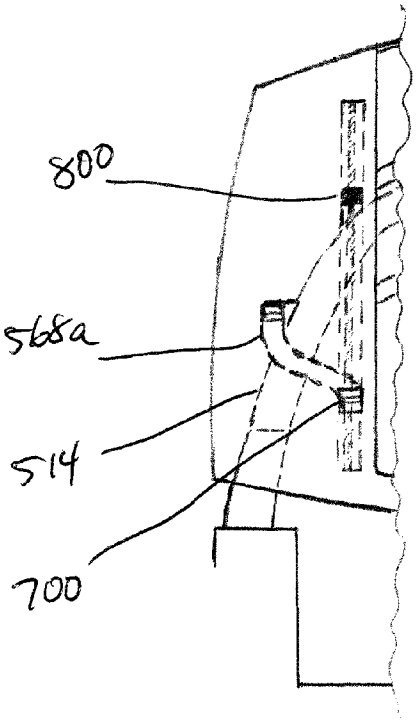
FIG. 6*d* is a partial view of an alternate link shape connecting the tower to the cargo rack.
Figure 6J:
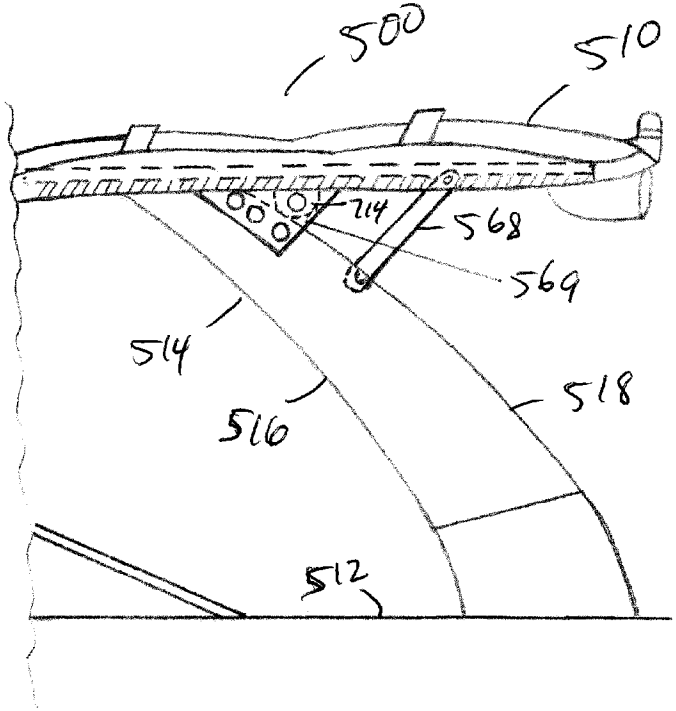
FIG. 6*c* is a bottom view of the cargo rack displacement mechanism.
FIG. 6*e* is top view of an alternate link shape.
FIG. 6*f* is top view of an alternate link shape.
FIG. 6*h* is rear view of a mounting adapter connecting the tower to the cargo rack.
FIG. 6*i* is side view of a mounting adapter connecting the tower to the cargo rack.

As shown in FIGS. 6*a*, 6*b*, and 6*c*, the first worm drive system 710 includes a first worm 711 positioned within first mounting tracks 712 which are positioned along the wall supports 528, 530. The first mounting tracks 712 include holes 712*a* extending along the length of the tracks 712.

The first worm drive system 710 further includes first worm gearing 714*a* positioned on a first rack connector 714.

The first rack connector worm gearing 714*a* includes teeth which interface with the first worm 711 to transmit force.

The first rack connector 714 further includes an attachment point 714*b* for connecting the first displacement mechanism 700 to strut 568 as shown at least in FIG. 1.

As shown in FIG. 6*c*, the first rack connector 714 also includes multi-position holes 714*c* for securing a displacement mechanism locking pin 717.

The second displacement mechanism 800 includes a second worm drive system 810 and may include a locking system 820.

As shown in FIGS. 6*a*, 6*b*, and 6*c*, the second worm drive system 810 includes a second worm 811 positioned within second mounting tracks 812 which are positioned along the wall supports 528, 530. The second mounting tracks 812 may include holes 812*a* extending along the length of the second mounting tracks 812.

The second worm drive system 810 further includes second worm gearing 814*a* positioned on a second rack connector 814.

The second rack connector worm gearing 814*a* includes teeth which interface with the second worm 811 to transmit force.

The second rack connector 814 further includes an attachment point 814*b* for connecting the second displacement mechanism 800 to the tower upper end pivot joint 519 as shown at least in FIG. 1.

As shown in FIG. 6*c*, the second rack connector 814 also may include multi-position holes 814*c* for securing a displacement mechanism locking pin 817.

Alternatively the first worm 711 and second worm 811 may be formed integral (not shown) and positioned within single a mounting track (not shown) formed by combining the first mounting tracks 712 with the second mounting tracks 812. If needed the applicable rack connector worm gear teeth 714*a*, 814*a* may be modified to ensure appropriate synchronized operation of the rack connectors 714, 814 to allow the cargo rack 510 to displace, translate, and pivot as desired.

Further it is understood the first and second displacement mechanisms 700, 800 may be comprised of alternate mechanisms which provide a means for translating, pivoting, and locking the cargo rack with respect to the tower. The alternate mechanisms include but are not limited to rack and pinion drive mechanisms, bevel gear arrangements, wire guided arrangement, sliding track arrangement, etc.

Figure 6H:
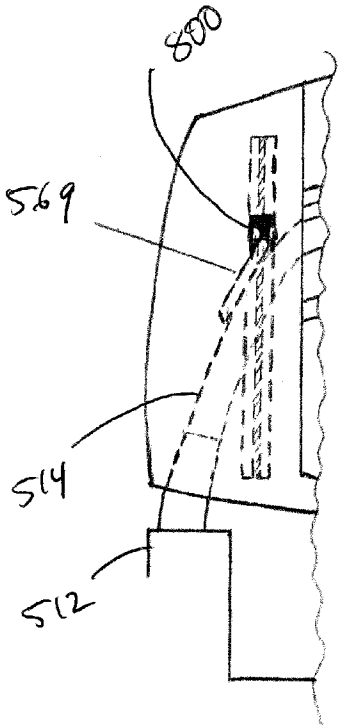
Figure 7:
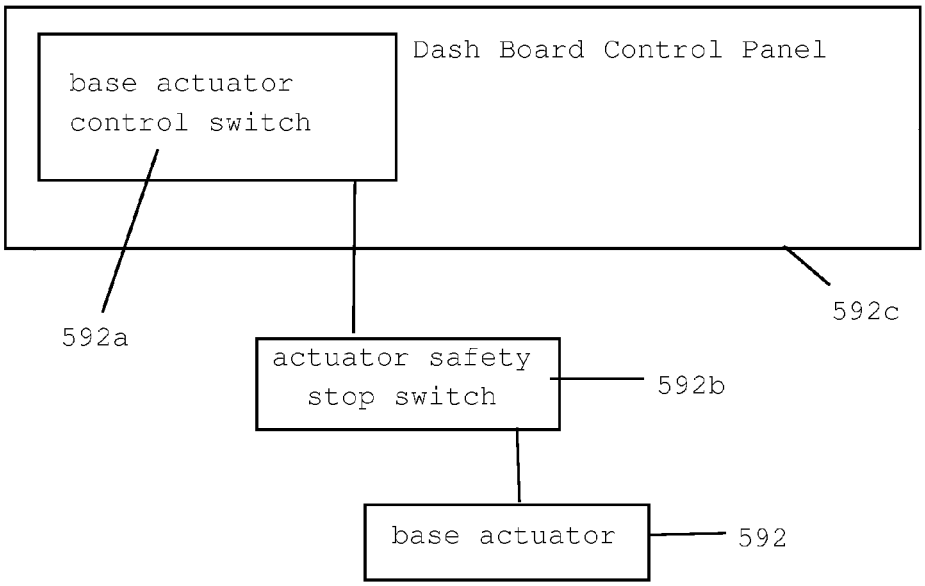
FIG. 7 is the base actuator control diagram.

Additionally, as shown in FIGS. 6*h* and 6*i* a mounting adapter 569 may be provided as an interface between the tower 514 and the second cargo rack displacement mechanism 800. In this configuration the second rack connector 814 is pivotally attached to the mounting adapter 569 which is rigidly attached to the tower 514.

Importantly, as the cargo rack 510 width is varied (as previously discussed) the angular alignment of the mounting tracks 712, 812 must be adjusted to allow proper translation and pivoting of the cargo rack 510. Further the shape of the tower 514 (such as the "A" shape of FIG. 5) may require the mounting tracks be positioned at an angle which minimizes binding of the displacement mechanisms 700, 800.

The use of mounting adapter 569 also aids in aligning the second mounting tracks 812 (which houses the second rack connector 814) to minimize binding of the displacement mechanisms 800 and allow proper translation and pivoting of the cargo rack 510.

Operation of the Displacement Mechanism

In the preferred embodiment, the first worm 711, as mounted within the first mounting tracks 712, is free to rotate clockwise or counter clockwise. As the first rack connector worm gear teeth 714*a* are pushed against first worm 711 it rotates allowing the first rack connector 714 to translate along the length of the applicable first mounting track 712. The first worm 711 may also be powered by a drive unit (not shown) which provides a means for rotating the first worm 711.

The second worm 811, as mounted within the second mounting tracks 812, is free to rotate clockwise or counter clockwise. As the second rack connector worm gear teeth 814*a* are pushed against second worm 811, the second worm 811 rotates allowing the second rack connector 814 to translate along the length of the applicable second mounting track 812. The second worm 811 may also be powered by a drive unit (not shown) which provides a means for rotating the second worm 811.

As the first rack connectors 714 translate along the first mounting track 712 the cargo rack 510 pivots about the strut 568, tilting the cargo rack 510 down and up while the second rack connectors 814 translate along the mounting track 812, lowering and raising the cargo rack 510 while in the tilted position, and the cargo rack 510 pivots about the tower upper end pivot joint 519.

Once the cargo rack 510 is properly positioned locking pins 717 are inserted through both the mounting rack holes 712*a* and the rack connector multi-position holes 714*c* to hold the cargo rack 510 in the desired position.

Cargo Rack Height Adjustment Operation

The cargo rack apparatus 500 adjustably pivots upward and downward about the strut 568 and the tower upper end pivot joint 519 thereby providing a variation in the height of the cargo rack apparatus' front wall 524 and back wall 526 as well as the height and position of the ski tow 520.

The fore and aft as well as upward and downward rake motion range of the cargo rack apparatus 500 provides the ability to adjust the effective height of the cargo rack apparatus 500 which allows user to control the amount of coverage from the harmful rays of the sun which can cause skin cancer or to protect boaters from wind and rain. Further, this unique range of movement of the cargo rack apparatus 500 allows users to adjust the bow-to-stern walk-through height as desired, as well as provides for lowering the cargo rack into the tilted position for easy access to stored equipment.

The tilting of the lower section of each tower 514 controls the height of the cargo rack apparatus 500. As shown in FIGS. 1-4 the tilting of the cargo rack apparatus 500 can be adjusted in coordination with the tilting of the tower 514 or the cargo rack apparatus 500 can be tilted independently of the tilting of the tower 514.

Further Operation Using the Struts

The struts 568 adjustably allow for the adjustment of the rake or angle of the cargo rack apparatus 500 and its interconnected peripheral rails.

This adjustability allows, for example, the boater to position the tow point (520) at the maximum height position so that wake boarders get higher in the air when doing maneuvers while also positioning the cargo rack apparatus 500 in the lowest position with the front wall 524 closest to the boat deck to simultaneously provide boat passengers maximum coverage from the sun, wind, and rain thereby enhancing the boating experience for all participants.

FIGS. 1-4 presents the height adjustable tower with integrated cargo rack apparatus 500 of the instant invention as it transitions from the fully extended position shown in FIG. 1 to the fully retracted position (stowed) as shown in FIG. 4. This allows users to vary the tower height (and thereby the cargo rack apparatus 500 height) and/or vary the cargo rack apparatus 500 rake or pitch angle and thereby adjust the ski tow attachment point).

The foregoing disclosure is sufficient to enable one having skill in the art to practice the invention without undue experimentation, and provides the best mode of practicing the invention presently contemplated by the inventor. While there is provided herein a full and complete disclosure of the preferred embodiments of this invention, it is not intended to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Accordingly, the proper scope of the present invention should be determined only by the broadest interpretation of the appended claims so as to encompass all such modifications as well as all relationships equivalent to those illustrated in the drawings and described in the specification.

What is claims is:

1. A height adjustable tower and cargo rack apparatus for wakeboard boats, said apparatus comprising:

a first tower base attached at its lower portion to a port side gunnel of said boat, the first tower base having a first tower base actuator;

a second tower base attached at its lower portion to a starboard side gunnel of said boat, the second tower base having a second tower base actuator;

a first tower mount pivotally attached to an upper portion of the first tower base at a first tower first pivot point joint;

a second tower mount pivotally attached to an upper portion of the second tower base at a second tower first pivot point joint;

first and second vertical supports pivotally extending from each tower mount, wherein the vertical supports are pivotally operated by their respective tower base actuator;

a pivotally and translatably adjustable cargo rack apparatus adjustably supported near the tower upper end.

2. The apparatus of claim 1 wherein each actuator is respectively connected at its first end to a forward lower portion of the respective tower mount and at its second end to an aft lower portion of the respective tower base, and wherein the first tower mount and the second tower mount pivot about the respective first pivot point joint when the respective actuator is extended or retracted.

3. The apparatus of claim 2 wherein each first pivot point joint includes a base locking mechanism which is locked to prevent rotation of the respective tower mount about the respective first pivot point joint, or unlocked to allow rotation of the respective tower mount about the respective first pivot point joint.

4. The apparatus of claim 1 wherein the width of the cargo rack exceeds the port gunnel to starboard gunnel width at the junction where the tower bases meet the boat gunnel.

5. The apparatus of claim 1 wherein the width of the cargo rack is less than the port gunnel to starboard gunnel width at the junction where the tower bases meet the boat gunnel such that the cargo rack, if unobstructed, could swing within the wakeboard tower.

6. The apparatus of claim 1 wherein the width of the cargo rack is equal to the port gunnel to starboard gunnel width at the junction where the tower bases meet the boat gunnel such that the cargo rack, if unobstructed, could swing down and abut the wakeboard tower.

7. The apparatus of claim 1 wherein translation of the cargo rack is provided by at least one displacement mechanism attached to at least one cargo rack support wall extending fore and aft and interconnecting peripheral rails of the cargo rack, wherein the at least one displacement mechanism includes a drive system and a locking system providing means for translating, pivoting, and locking the cargo rack with respect to the tower.

8. The apparatus of claim 7 having a port cargo rack support wall and a starboard cargo rack support wall wherein the drive system is a first worm drive system and a second worm drive system each having a worm positioned within a mounting track segment which is exclusively positioned along either the port or starboard support wall, wherein each mounting track includes a plurality of holes extending along its length, wherein each worm drive system further includes a rack connector positioned within the applicable mounting track, the rack connector including gearing teeth which interface with the worm, wherein a strut pivotally connects the first worm drive rack connector to the tower, and wherein the second worm drive rack connector is connected to the tower at a tower upper end pivot joint, wherein as each rack connector translates along the applicable worm, the cargo rack translates fore and aft and also pivots about the strut and tower upper end pivot joint.

* * * * *